US005967518A

United States Patent [19]

Rowe

[11] Patent Number: 5,967,518

[45] Date of Patent: Oct. 19, 1999

[54] SPORTS RELATED DART GAME APPARATUS AND METHOD

[76] Inventor: Wayne Rowe, 141 Courcelette Road, Toronto, Ontario, Canada, M1N 2T1

[21] Appl. No.: 08/926,679

[22] Filed: Sep. 10, 1997

[51] Int. Cl.[6] ..... F41J 3/02

[52] U.S. Cl. ..... 273/317.5; 273/371; 273/408; 273/409

[58] Field of Search ..... 273/371, 372, 273/373, 374, 375, 376, 377, 403, 408, 409, 317.5, 317.1, 317.3, 317.4, 317.6

[56] References Cited

U.S. PATENT DOCUMENTS

| | | | |
|---|---|---|---|
| 3,979,117 | 9/1976 | Worsham | 273/408 |
| 4,057,251 | 11/1977 | Jones et al. | 273/408 X |
| 4,516,781 | 5/1985 | DeVale et al. | 273/373 |
| 4,635,940 | 1/1987 | Kelley | 273/346 |
| 4,768,789 | 9/1988 | Clark | 273/371 |
| 4,893,822 | 1/1990 | Tesa et al. | 273/376 |
| 4,955,967 | 9/1990 | Houriet, Jr. et al. | 273/372 |
| 4,974,857 | 12/1990 | Beall et al. | 273/371 |
| 5,004,247 | 4/1991 | Menke | 273/376 |
| 5,005,842 | 4/1991 | Bauer | 273/408 |
| 5,664,782 | 9/1997 | Lacks et al. | 273/317.5 |

FOREIGN PATENT DOCUMENTS 1276301 1/1987 Canada .

OTHER PUBLICATIONS

Creative Colleagues, Inc., "Sport Darts", 1990–1996, boxing, hockey and baseball target sheets.

*Primary Examiner*—William H. Grieb
*Attorney, Agent, or Firm*—Bereskin & Parr

[57] ABSTRACT

A game apparatus and method played by throwing projectiles (such as darts) at a playing surface. The playing surface includes field markings that depict a sports field in perspective view. The playing surface also includes target markings that define offensive targets and defensive targets. The defensive targets resemble silhouettes of players involved in various action modes of a game. An active counter is provided for awarding score values according to factors such as time elapsed between when an offensive target is hit and a defensive target is hit.

34 Claims, 13 Drawing Sheets

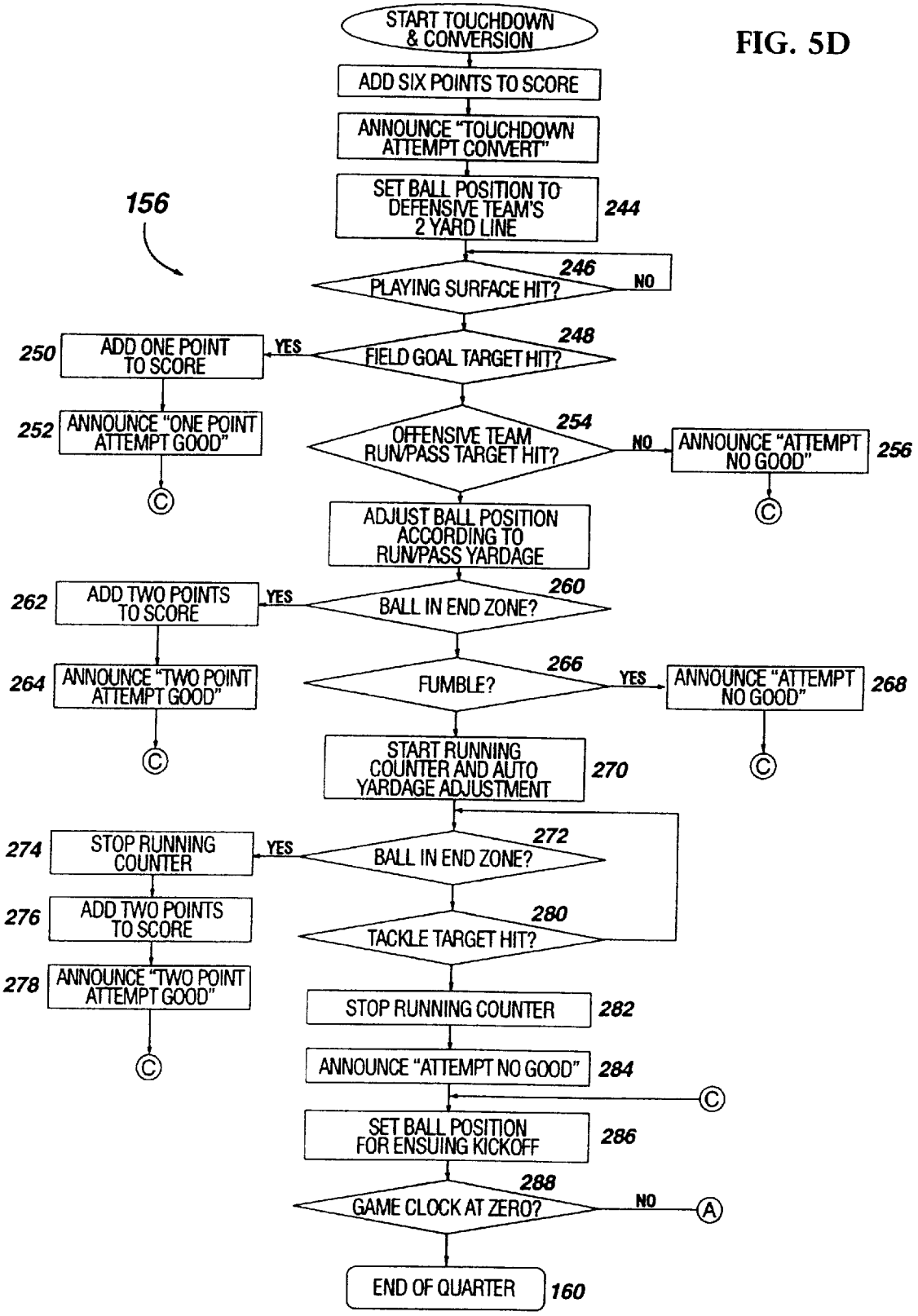
FIG. 5D
156
START TOUCHDOWN & CONVERSION
ADD SIX POINTS TO SCORE
ANNOUNCE "TOUCHDOWN ATTEMPT CONVERT"
SET BALL POSITION TO DEFENSIVE TEAM'S 2 YARD LINE
244
PLAYING SURFACE HIT?
246
NO
FIELD GOAL TARGET HIT?
248
YES
250
ADD ONE POINT TO SCORE
252
ANNOUNCE "ONE POINT ATTEMPT GOOD"
C
OFFENSIVE TEAM RUN/PASS TARGET HIT?
254
NO
ANNOUNCE "ATTEMPT NO GOOD"
256
C
ADJUST BALL POSITION ACCORDING TO RUN/PASS YARDAGE
BALL IN END ZONE?
260
YES
262
ADD TWO POINTS TO SCORE
264
ANNOUNCE "TWO POINT ATTEMPT GOOD"
C
FUMBLE?
266
YES
ANNOUNCE "ATTEMPT NO GOOD"
268
C
START RUNNING COUNTER AND AUTO YARDAGE ADJUSTMENT
270
BALL IN END ZONE?
272
YES
274
STOP RUNNING COUNTER
276
ADD TWO POINTS TO SCORE
278
ANNOUNCE "TWO POINT ATTEMPT GOOD"
C
TACKLE TARGET HIT?
280
STOP RUNNING COUNTER
282
ANNOUNCE "ATTEMPT NO GOOD"
284
C
SET BALL POSITION FOR ENSUING KICKOFF
286
GAME CLOCK AT ZERO?
288
NO
A
END OF QUARTER
160

SPORTS RELATED DART GAME APPARATUS AND METHOD

FIELD OF THE INVENTION

The present invention relates to a game apparatus and method played with projectiles such as darts.

BACKGROUND OF THE INVENTION

A dart game is typically played with three darts that are thrown in succession at a circular sectored board. Numerous games have been developed over the years incorporating the basic elements of darts and a dart board. Included among these games are sports-related games such as adaptations of North American football. Examples of dart football games are described in U.S. Pat. Nos. 3,979,117 (Worsham), 4,893,822 (Tesa) and 5,005,842 (Bauer). Each of these patents are directed to games that feature one or more circular boards having sectors that are representative of offensive plays in a football game. The games are played by throwing darts at desired targets on the board to acquire specific yardage values and score a touchdown or a field goal.

One problem with such conventional sports-related dart games is their failure to adequately mimic the live action and complex interaction associated with the sports. Another problem with such conventional dart games is the lack of visual similarity to the specific aspects of the sport they are adapting.

SUMMARY OF THE INVENTION SUMMARY

The present invention improves upon conventional sports-related dart games by providing realistic perspective view graphics of the sport and active targets that provide offensive and defensive interaction to better mimic some of the live action aspects of sports.

In a first aspect, the present invention provides a game apparatus comprising:

a playing surface for receiving projectiles;

at least one active target defined on said surface, said active target defining at least one action zone and at least one reaction zone;

sensor means associated with said surface for electronically sensing when and where a projectile hits said surface;

active counter means communicating with said sensor means for awarding score values according to a measuring factor occurring between when said action zone of said active target is hit and when said reaction zone of said active target is hit; and processing means for receiving and processing information from said sensor means and from said active counter means and awarding a score.

In another aspect, the present invention provides a method for playing a projectile throwing game comprising the following steps:

(a) selecting a playing surface for receiving projectiles, said playing surface having at least one active target, said active target having at least one action zone and at least one reaction zone;

(b) throwing a projectile at said playing surface;

(c) determining the position where said projectile hits said playing surface;

(d) assigning a score value according to where said projectile hits said scoring surface, wherein, when said projectile hits said action zone of said active target, said score value is contingent on a measuring factor based on when a subsequent projectile hits said reaction zone of said active target; and (e) repeating steps (b), (c) and (d) until a game is completed. In another aspect, the present invention provides a game apparatus comprising:

a playing surface for receiving projectiles, said playing surface including visible markings that depict a sports field;

a plurality of targets having different surface areas defined on said playing surface; and scoring means associated with said playing surface for awarding a predetermined score according to whether one of said targets is hit, said score for each target varying inversely with the surface area of said target.

BRIEF DESCRIPTION OF THE DRAWINGS

For a better understanding of the present invention, and to show more clearly how it may be carried into effect, reference will now be made, by way of example, to the accompanying drawings. The drawings show preferred embodiments of the present invention, in which.

DETAILED DESCRIPTION OF THE PREFERRED EMBODIMENT

The Game Apparatus

Figure 1:
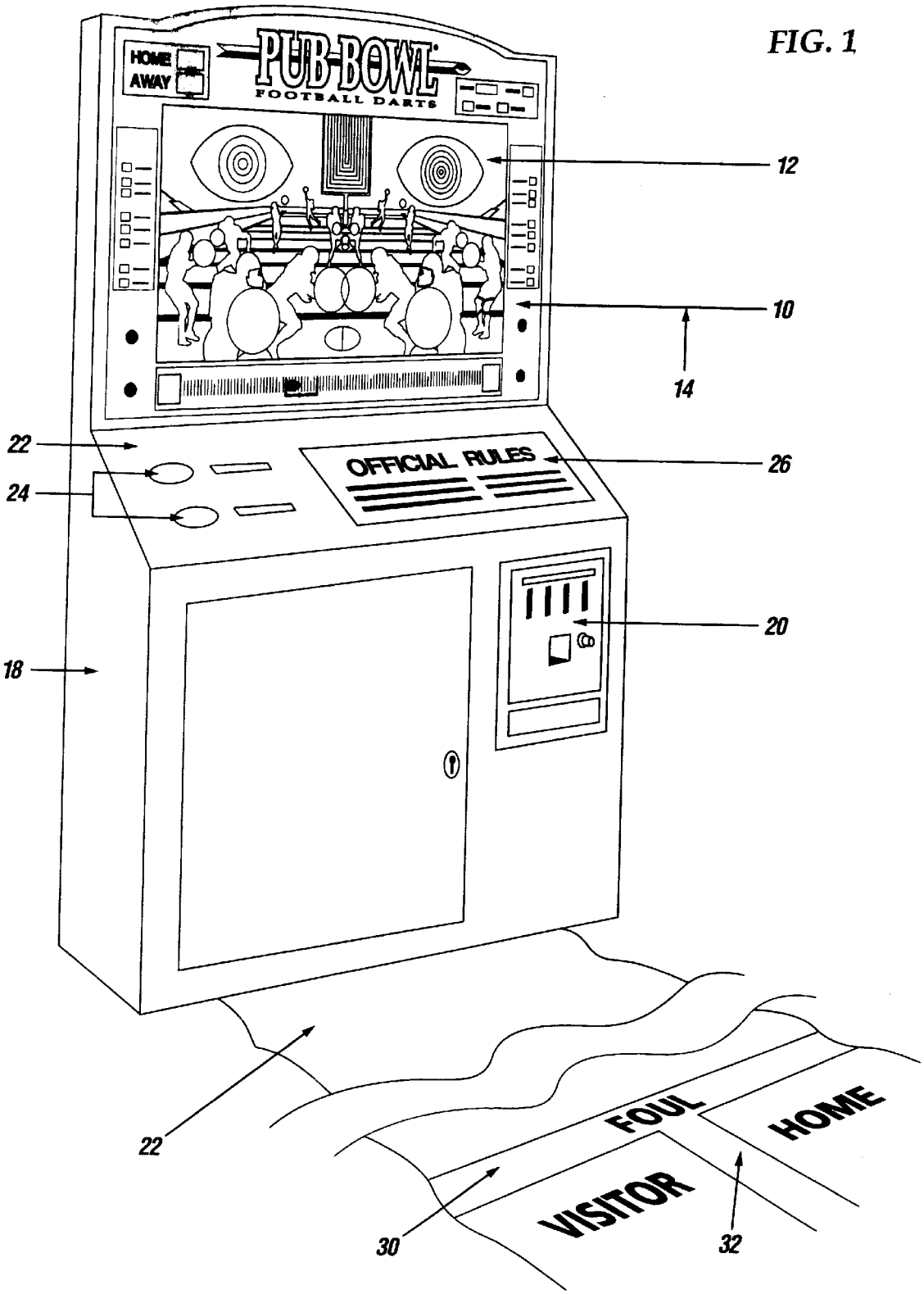
FIG. 1 is a perspective view of a game apparatus and cabinet in accordance with the present invention.
Figure 2:
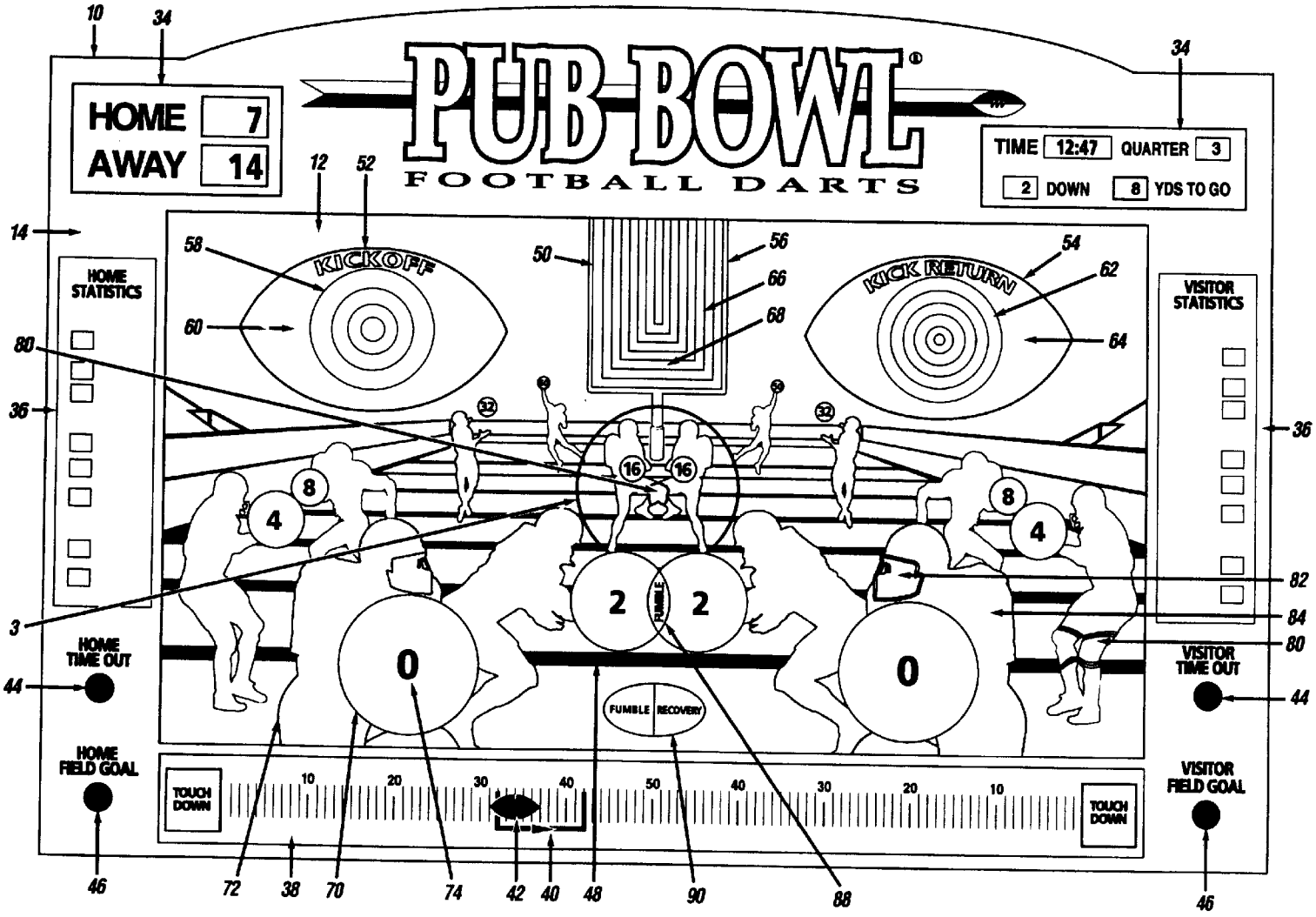
FIG. 2 is an enlarged front view of the playing surface for the game apparatus of FIG. 1.

A game apparatus in accordance with the present invention is shown generally at 10 in FIGS. 1 and 2. The apparatus 10 includes a playing surface 12 bordered by a display surface 14. The playing surface 12 is adapted to receive projectiles which most preferably are darts. The playing surface depicted in the figures and described below is for a North American football game. It is contemplated that the invention may be adapted to a number of other sports involving active defensive and offensive interaction such as baseball, hockey and the like. Also, entirely new games could be developed that incorporate the novel features of this invention.

Referring to FIG. 1, the game apparatus 10 is incorporated into a cabinet 18 so that the game may be played in an arcade environment. The cabinet 18 also includes a currency operation assembly 20 for receiving a coin, token or debit card for activating the game as known to those skilled in the art. The cabinet 18 supports the playing surface 12 at a predetermined height above the ground (preferably eye level). The cabinet 18 includes a control panel 22 with push button switches 24 for selecting among different game options including the number of players and different skill levels. An instruction panel 26 is also provided on the cabinet 18 for displaying instructions on playing the game.

A floor marker 28 is located on the floor in front of the cabinet 18 to define boundaries for positioning players. The marker includes a foul line 30 located parallel to, and preferably eight feet from, the playing surface 12. Players may not step past the foul line 30 when throwing darts. The floor marker 28 also includes a center line 32 located perpendicular to the foul line 30 for designating "home" and "visitor" sides of the floor marker 28. As will become evident from the description below, it is desirable to separate the positions where the players from the two teams throw darts because they may be throwing in very close succession to each other and could get into each other's way.

(a) Display Surface

The display surface 14 is located about the perimeter of the playing surface 12. The display surface 14 includes a number of indicators for conveying information to the players of the game. These indicators include a score monitor 34, for displaying information concerning game time, quarter, ball possession, field position, down, yards to first down, home score and visitor score. Statistic monitors 36 are also provided for indicating the respective team's performance in categories such as passing, field goals and kickoffs or punts.

The display surface 14 also includes a field position monitor 38 that visually indicates the position of the football relative to the two end zones. The field position monitor 38 includes a ten yard bar 40 for indicating the original line of scrimmage for a new set of downs and the distance required to obtain a first down. As described further below, the position of the football 42 on the field position monitor 38 changes continually as yardage is gained or lost during a particular play.

The display surface 14 also includes timeout buttons 44 for each team to interrupt the game time for a predetermined interval (sixty seconds is preferred). In addition, a field goal button 46 is provided to alert the game operating components that a player is attempting to score a field goal.

(b) Playing Surface

The playing surface 12 includes field markings 48 that visually depict a perspective downfield view of a football stadium including the stands, the yard lines and one end zone, including the field goal posts 50. The playing surface 12 also includes target markings that define distinct targets for receiving the darts. There are two categories of targets, passive targets and active targets. The passive targets, like conventional dart targets, provide a distinct predetermined outcome (such as the awarding of a predetermined yardage value) when struck by a dart. The active targets, on the other hand, provide a contingent outcome depending on measuring factors occurring between an action and a corresponding reaction. The measuring factors include the number of subsequent darts thrown, the location of subsequent darts thrown and the elapsed time between an action play and a reaction play. These "active" factors are described in more detail below.

(c) Passive Targets

The passive targets include a kickoff/punt target 52, a kick return target 54, and a field goal/convert target 56.

The kickoff/punt target 52 includes a series of concentric yardage zones 58. Each yardage zone has a corresponding kickoff yardage value 60. In the preferred embodiment, five yardage zones are defined with the center-most zone having a kickoff yardage value of seventy yards (corresponding to what is reasonably considered to be the longest possible kickoff distance in a real game of football). The remaining yardage zones have yardage values (moving outwardly) of sixty yards, fifty yards, forty yards and thirty yards.

The kick return target 54 includes a series of concentric yardage zones 62. Each yardage zone has a corresponding kick return yardage value 64. In the preferred embodiment, seven kick return yardage zones are defined with the center-most zone having a kick return yardage value of a touchdown (corresponding to what is the longest possible kick return distance in a real game of football). The remaining yardage zones have yardage values of (moving outwardly) sixty-four yards, thirty-two yards, sixteen yards, eight yards, four yards and two yards.

The field goal/convert target 56 is located between the goal posts 50 marked on the playing surface 12. The field goal/convert target 56 includes a series of U-shaped yardage zones 66. Each yardage zone has a corresponding field goal/convert yardage value 68. In the preferred embodiment, eight yardage zones are defined with the center most zone having a field goal/convert value of sixty-five yards (corresponding to what is reasonably considered to be the longest possible field goal kicking distance in a real game of American football). The remaining yardage zones have yardage values of (moving outwardly) sixty yards, fifty-five yards, fifty yards, forty-five yards, forty yards, thirty-five yards and thirty yards.

(d) Active Targets

The active targets include run/pass targets 70 and tackle targets 72. The run/pass targets 70 may be considered "action" zones and the tackle targets 72 may be considered "reaction" zones. For every "action" initiated by hitting a run/pass target 70, a corresponding "reaction" is required by hitting a tackle target 72.

The run/pass targets 70 are circular and have a corresponding yardage value 74. In the preferred embodiment, the run/pass targets 70 that are located at the lower half of the playing surface 12 are larger in size than the run/pass targets 70 located at the upper half of the playing surface 12. This corresponds to the perspective downfield view that is marked on the playing surface 12. The smaller run/pass targets 70 represent passing distances that are further downfield (and thus more difficult to hit) than the larger run/pass targets 70.

The largest run/pass target 70 in the preferred embodiment has a yardage value of zero yards. This largest run/pass target 70 thus corresponds to a running play with yardage to be gained subsequently by the running counter 76 that is described further below. The remaining run/pass targets 70 correspond to passing plays and have yardage values of (moving upwardly) two yards, four yards, eight yards, sixteen yards, thirty-two yards and sixty yards (with sixty yards corresponding to what is reasonably considered to be the longest passing distance in a real game of football). The eight yard run/pass target 70 has an added feature of stopping the clock by "running out-of-bounds". This occurs after a reasonably short amount of running time as measured by the running counter 76 after the run/pass target 70 is struck with a dart. The ball advances eight yards plus a further one yard during running time before it is carried out of bounds to stop the clock.

The tackle targets 72 are shaped like football players in various action modes. The tackle targets 72 are arranged on the playing surface 12 in appropriate positions relative to the run/pass targets 70 to resemble a football player receiving a football by a handoff or a pass. Accordingly, the run/pass targets 70 are generally positioned overlying or adjacent to the hands of the football player shaped tackle target. Similar to the run/pass targets 70, the tackle targets 72 decrease in surface area from the bottom of the playing surface to the top of the playing surface. This corresponds to the perspective downfield view marked on the playing surface 12.

Penalty zones are marked in some of the tackle targets 72. The penalty zones include a clipping zone 80 located at the knees of the player, a face mask zone 82 located at the face mask of the player, an unnecessary roughness zone 84 located at the back of the head of the player, an unsportsman-like conduct zone 86 located at the groin of the player and an interference zone 87 where two opposing players overlap. Each penalty zone has a corresponding penalty value (not shown) associated with it.

Fumble zones 88 are located on at least one of the run/pass targets 70, as well as on at least one of the tackle targets 72. A fumble recovery zone 90 is located at the lower end of the playing surface 12 away from the other targets. The fumble recovery zone 90 is divided into two regions corresponding respectively to a visiting team recovery and a home team recovery.

(e) Running Counter

When a run/pass target 70 is hit with a dart, yardage is awarded in accordance to the yardage value assigned to the run/pass target 70. The play remains live or "active" and further yardage is gained until either a successful defensive tackle is made (ie. a dart successfully strikes the tackle target 72 corresponding to the run/pass target 70 that was previously hit) or a touchdown is scored. The yardage gain is determined by the active counter means or running counter 76 which preferably tracks the elapsed time (or less preferably the number of tackle darts thrown) from the time when the run/pass target 70 was hit to the time when the corresponding tackle target 72 is hit.

In the most preferred embodiment, the running counter 76 includes a timer 92 to track the number of seconds that elapse between the time that the run/pass target 70 is hit and the time the corresponding tackle target is hit. The running counter 76 has preset values for awarding yardage per second elapsed. This "running speed" may be varied according to each player's level of skill. Beginners will set the difficulty of play at "level 1" while skilled participants will set the difficulty of play at "level 3". Participants of average skill, or "level 2" types will have approximate running speeds (expressed in seconds/yard) as follows: first yard—2 sec/yd, each of second and third yard—1.75 sec/yd, each of fourth and fifth yard—1.5 sec/yd, each of sixth and seventh yard—1.25 sec/yd, each of eighth and ninth yard—1 sec/yd, each of tenth to fifteenth yard—0.75 sec/yd, each of sixteenth to touchdown—0.5 sec/yd.

In a less preferred embodiment, the running counter 76 tracks the number of darts thrown at the respective tackle target before it is successfully struck. Again, the yardage gain can vary according to the assigned skill values. For an "average" skill level, the running speeds (expressed as yards/dart) may be as follows: each of first and second missed tackle darts —two yards/dart, each of third and fourth missed tackle darts—five yards/dart, fifth missed tackle dart—ten yards/dart, sixth missed tackle dart—touchdown. This latter embodiment of running counter 76 is less preferred since it does not feature the time pressure associated with the first target. However, the second embodiment may be considered a safer method of play since players will not feel rushed to throw darts which could inadvertently result in a player being struck with a dart.

It should be noted that the running counter 76 operates during an "interception" as well. In other words, when an offensive player throws a dart that hits one of the defensive player's run/pass targets 70 an interception (change in ball possession) occurs and the ball position is changed according to the yardage value for the respective run/pass target hit. The yardage then continues to be gained as measured by the running counter 76 until a successful tackle dart is thrown (note, the team who threw the interception would now be throwing the tackle darts).

(f) Dart Sensor

The playing surface 12 includes an electronic sensing means for sensing the position of a projectile or dart that has struck the surface. Various forms of sensing means are known and the present invention is not intended to be limited to any one form. Suitable sensing means are disclosed in U.S. Pat. Nos. 4,057,251 (Jones), 4,516,781 (DeVale), 4,635,940 (Kelley) and 4,768,789 (Clark). All of these patents are incorporated herein by reference.

Figure 3:
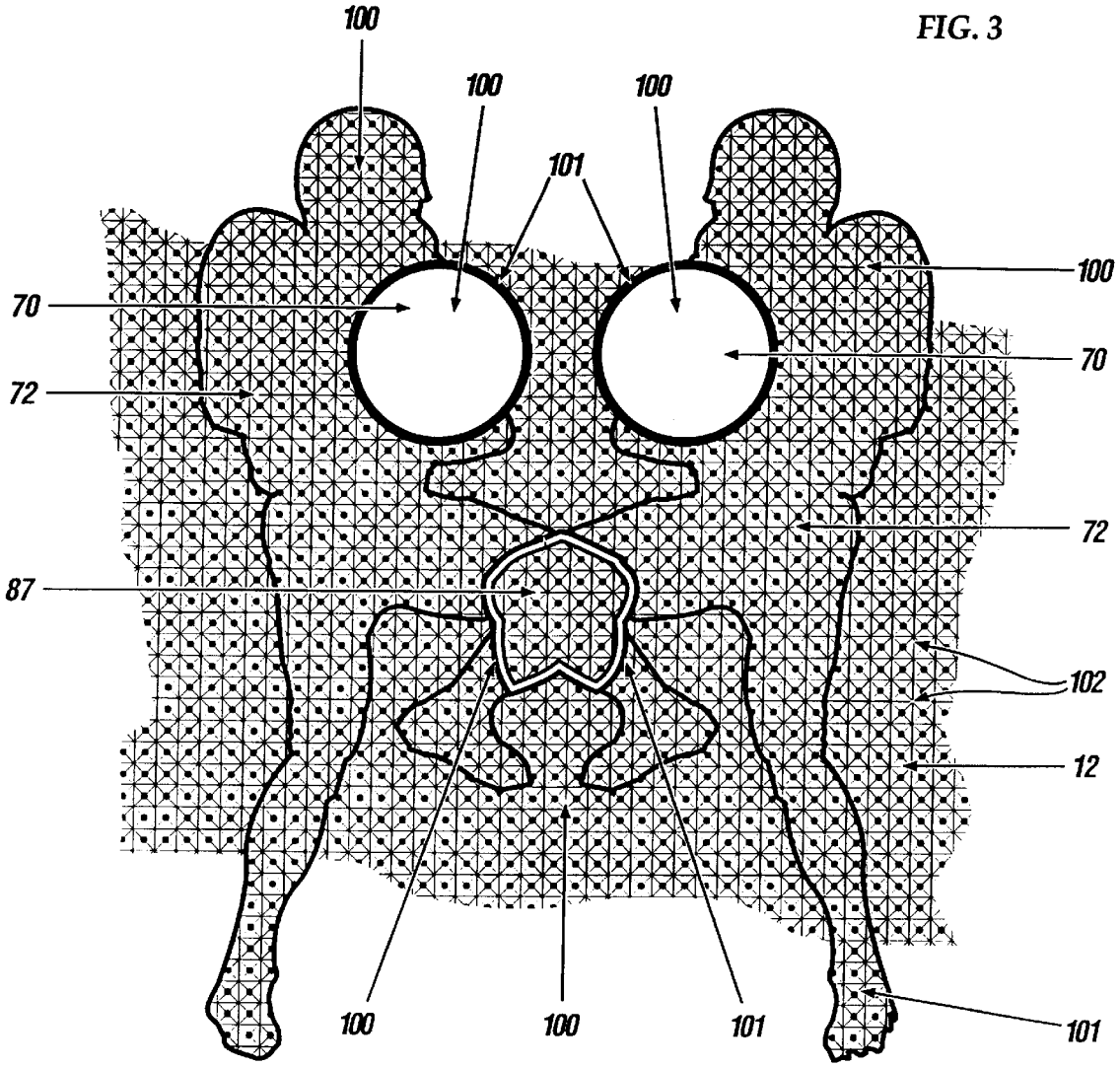
FIG. 3 is an enlarged front view of a portion of the playing surface indicated by arrow 3 in FIG. 2.

The currently preferred sensing means (see FIG. 3) comprises an array of target plates 100 arranged on the playing surface 12 and physically divided by perimeter separators 101 (e.g. rounded wire or plastic). A series of holes 102 are defined in the target plates 100 for receiving and holding the tip of a dart. Each target plate shifts inwardly upon being struck by the dart and effects closing of a switch (not shown) for producing a scoring signal. This form of sensing means, as described in detail in the Jones, DeVale and Kelley patents incorporated by reference herein, is preferred for use in public areas (such as arcades) or by children since plastic blunt tipped darts may be used. For those that prefer the use of conventional steel tipped darts and bristle boards, the sensing means disclosed in the Clark patent (incorporated herein by reference) is preferred.

(g) Operating Components

Figure 4:
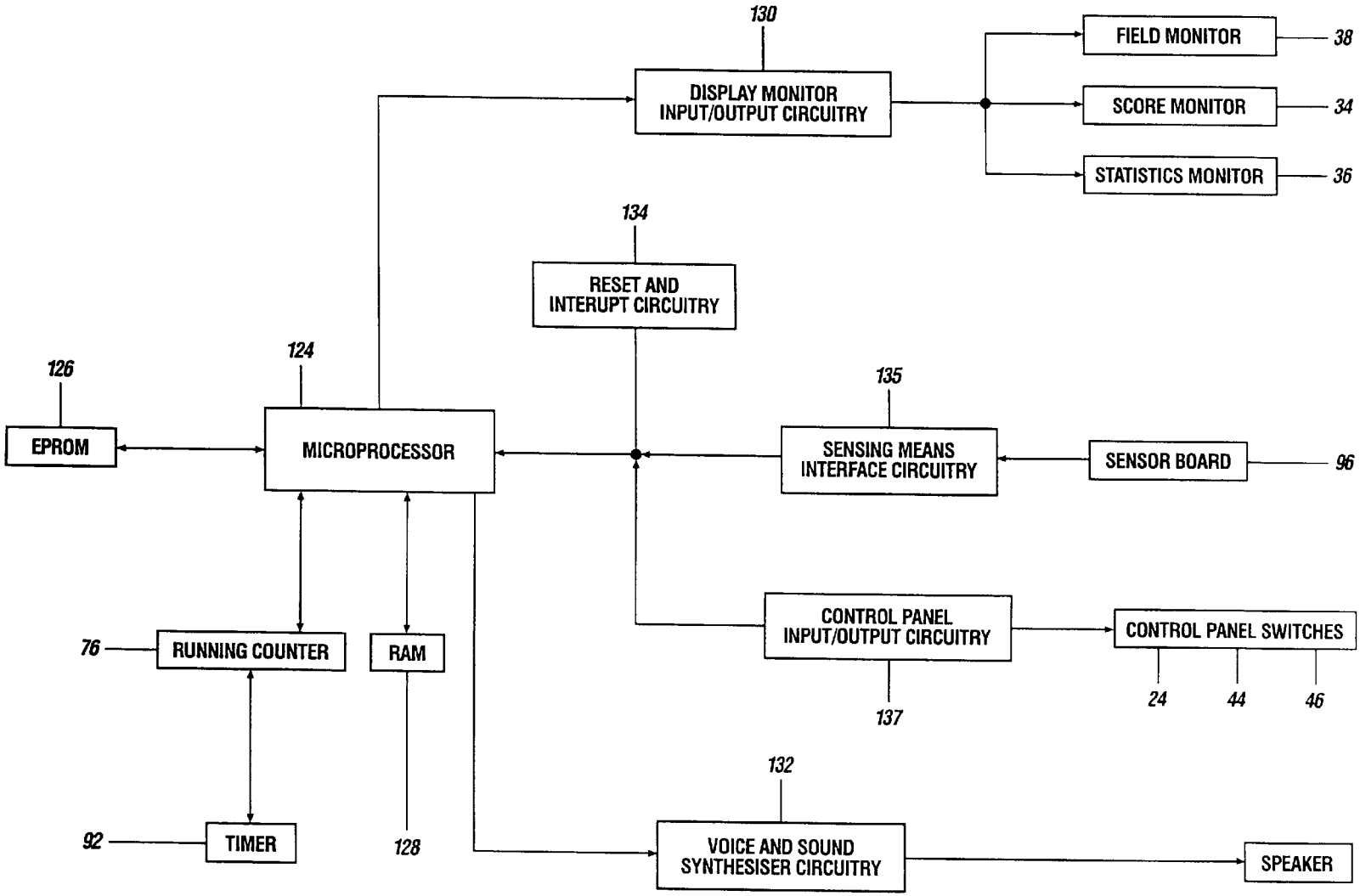
FIG. 4 is a block schematic view of the operating components for the game apparatus of FIG. 1.

A block diagram of the operating components for the electronic game apparatus 10 is depicted in FIG. 4. The operating components include a microprocessor 124 for reading signals originating from the sensor board via the sensing means interface circuitry 135. The sensing means interface circuitry 135 includes amplification means (not shown) and analog pulse type signal converting means (not shown) for converting the analog signal generated when the dart is sensed by the sensing means to a digital signal readable by the microprocessor 124.

The microprocessor 124 uses RAM (random access memory) 128 to calculate and store temporary values, such as field position and score. Preferably, a small portion of RAM 128 is made non-volatile by way of an internal battery backup (not shown) so that it may be used by the microprocessor 124 to store high scores, game popularity data or other similar values which are desired to be retained when the power is turned off. It is contemplated that secondary RAM might also be used to link the game apparatus 10 with a base unit (not shown) for collecting data from a plurality of game apparati 10 at a plurality of locations.

An EPROM (erasable programmable read only memory) 126 is also accessible by the microprocessor 124 and contains all of the necessary control and processing instructions for proper operation of the games. This includes instructions for initialization, game and player selection processes, and all of the instructions necessary to play each of the available games. A preferred embodiment of these instructions is depicted in the flow chart of FIG. 5 (a–j). The microprocessor 124 also controls and generates appropriate visual displays and audio announcements based on the state of the game by way of display surface monitor circuitry 130 and audio speaker circuitry 132.

Synchronization of the various operations of the system is achieved by the reset and interrupt timing circuitry 134 which alerts the microprocessor 124 to interrupt and reset conditions, such as may occur when coins are deposited into the coin operation assembly 20 or certain control panel 22 signals are received. The push button switches 24, 44 and 46 link signals from the control panel 22 to the microprocessor 124 by the control panel input/output circuitry 137.

The Game (a) Number of Players

The game can be played with one player against a random set of variables determined by the microprocessor 124. The preferred method of play, however, is with at least two participants, one representing each team. The game may be played as a team game by dividing up more than two participants into two teams. Team play is best with four participants, two on each team. The number of participants on each team should be the same, but this is not required. Two against three for example will work well if the team with only two participants has more skill. The advantage of an extra team member is realized when playing defence. More than three on a team is awkward due to overcrowding in the throwing area.

(b) Beginning the Game

The electronic coin-operated version of the game is begun by depositing the appropriate number of coins etc. into the currency operation assembly 20. Prior to depositing coins, the players will have determined whether they are playing for the visitor team or home team, the teams being identified by appropriate jerseys worn by the player images depicted on the playing surface 12. The game is set up so that each game begins with the visitor team kicking off and the home team receiving and therefore having first offensive ball possession. As in real football, the winner of a coin toss will usually opt to be the home team in order to receive the first ball possession.

(c) Game Duration

A game is one hour in length with four fifteen minute quarters as in traditional football. The time remaining in a quarter is monitored by a game clock, which is shown in the score monitor 34 in FIG. 2. In an arcade environment, however, it may be preferred to set a shorter time period than one complete game before more coins are deposited. For instance, each quarter may be sold separately. The time deducted from the game clock for a given play will vary with each play, and it may also be a fixed amount depending on the type of play and/or yardage gained, regardless of the actual length of the play in "real time." As in real football, clock stoppages would occur after touchdowns, between quarters, when either of the two designated out-of-bound ball carriers (eight yard run/pass targets) runs out of bounds, when an attempted pass is incomplete, when there is a penalty, when the teams change possession of the ball and when there are two minutes remaining in the game (the two minute warning). The only other way to stop the clock is to manually push the timeout button located on the display surface 14. Each team is allowed two timeouts per game with each being a sixty second clock stoppage. The out-of-bounds ball carriers are preferably assigned the eight yard ball distance. Every time these ball carriers take possession, they run for two seconds (one yard) then step out of bounds, thus stopping the clock. This becomes a tactical strategy, something to pursue or avoid, in the final seconds of the game. It is a desirable target when a team needs several plays, or downs, in order to get into scoring range on the field before time runs out. It is an undesirable target when a team having a lead and having ball possession wishes to "eat up the clock" thus giving the opponent less time to come back and win. It is also contemplated that an "undo button" (not shown) might be incorporated into the game apparatus 10 in order to account for errors in play or electronic malfunction. For instance, a defensive player may over-react and throw a defensive "tackle" dart before an offensive player has begun "running" as described below. The undo button (not shown) would permit the last dart to be ignored and play resumed as if it had not been thrown.

(d) Kickoff

Each half of the game begins with the ball being electronically registered on the field monitor on the kicking team's thirty yard line. A participant representing the kicking team throws the first dart at the kickoff/punt target 52 positioned in the upper left area of the playing surface 12. The successful throw result is awarded a yardage value that is registered on the statistics monitor and the field monitor. If the dart misses the kick/punt target completely, the ball position moves back ten yards to the kicking team's twenty yard line and they throw another dart. If the second kickoff dart also misses the kick/punt target, the ball position moves back another ten yards and the kicking team makes its third and last attempt to kickoff from their ten yard line. If this kickoff dart also misses the kick/punt target completely, the receiving team assumes ball position at their own forty yard line, as registered on the field monitor.

(e) Kick Return

A participant representing the receiving team throws one dart at the kick return target 54 positioned in the upper right area on the playing surface 12. The throw result is registered on the statistics monitor and the field monitor. If the receiving team misses the kick return target 54 completely, the kick return is scored as zero yards. There are no second dart attempts on kick returns. The field monitor registers no ball movement after the kickoff and remains at the place on the field it was kicked to.

(f) Offensive Play

The scoreboard now shows that it is a particular team's (the offensive team) first down with ten yards to go. The only exception to this is if the ball happens to be positioned inside the defensive team's ten yard line in which case it would display first down with goal to go. An offensive team player throws their first dart at any of the run/pass targets 70 illustrated on the board that are positioned next to or "being caught" by ball carriers wearing the jerseys representing their team. If the first dart misses all of the offensive team's run/pass targets 70, an "incomplete pass" is scored. The ball position does not move and the score monitor 34 now displays second down. If the dart successfully hits an offensive team run/pass target 70, a "complete pass" is scored (unless the pass would be completed out of bounds beyond the back of the end zone). The field monitor registers the ball movement according to the yardage value associated with the run/pass target 70 and from the moment the dart makes contact, it adds (with the input from the running counter) the successive yardage the offensive receiver is gaining while "running" with the football 42. Yardage gains of ten yards or more over four downs creates a new first down.

If a dart pass inadvertently hits a defensive team's run/pass target 70, an "interception" is scored. In this case, the field monitor would track the ball downfield according to the yardage value associated with the respective run/pass target hit and then it switches direction and moves back in the direction from which it was thrown according to the running time as determined by the running counter 76.

(g) Defensive Play

Assuming that a pass was complete and the ball carrier is "running" towards the defensive team's end zone, a participant representing the defensive team throws successive "tackle" darts at the ball carrier image (i.e. the tackle target) that "caught" the football 42 (i.e. the image that is adjacent to the run/pass target 70 that was hit). Any number of tackle darts can be thrown with the preferred method of play using six darts. It is preferred to have nine darts per team to ensure that six darts are available for throwing at all times. This is important because participants should not be approaching the playing surface 12 when the ball carrier is "live" and running with the ball.

The six tackle darts may be thrown by one player or divided amongst team mates. In the case of the running counter 76 operating on the basis of elapsed time, these tackle dart throws are made in rapid succession because the dart contact with the ball carrier is what stops further yardage accumulation. In team play, two defensive participants can line up on their own side of the field and throw tackle darts simultaneously. This is the one time in the game where one participant playing against two would realize his or her handicap. When all six tackle darts are in the dart board and a ball carrier has not been successfully tackled, the ball carrier will continue to run into the end zone scoring a touchdown.

(h) Field Goals and Punts

On fourth down and long situations, two types of kicks are optional, a field goal or a punt.

A field goal is possible when the ball is anywhere on the defensive half of the field. Before attempting a field goal, the player pushes the field goal button 46 located on the display surface 14. This alerts the microprocessor 124 that only a dart that hits the field goal target is to be scored. Since it is possible that a field goal may be attempted on any down (i.e. depending on how much time is remaining in the half or in the game), it is necessary to alert the microprocessor 124 when a field goal is being attempted. In order to score a field goal, the kicker must hit the field goal target yardage value that is equal to or greater than the number of yards downfield the kicker is from the opposing team's field goal uprights. This is typically seven yards further downfield than the line of scrimmage. Therefore, if the ball is on the defensive team's thirty yard line, a field goal would need to be forty-seven yards for a completion.

A punt, on the other hand, is accomplished by throwing a punt dart at the kick target. There is no need to alert the microprocessor 124 that a punt is being attempted since it would only be attempted on the fourth down. Thus, the microprocessor 124 can be programmed to automatically score a punt on fourth downs only. The opposing team returns the punt by throwing a punt return dart at the kick return target 54.

If the player does not hit a run/pass target 70, a kick/punt target or a field goal target in their fourth down attempt, ball possession changes with the ball remaining in the same position in the field, unless the ball position is inside the twenty yard line of the team obtaining possession and a field goal has been attempted. In that case, the team obtaining possession starts at their own twenty yard line.

(i) Penalties

When a tackle dart hits a designated penalty zone on a tackle target, the resulting contact will result in stoppage of the running counter 76 and an award to the offensive, or victimized team, of the greater of (i) a first down with the ball advanced either ten or fifteen yards downfield toward the defender's end zone according to the assigned penalty or (ii) the accumulated distance until the tackle resulting in the penalty occurred. An offensive offside penalty may also be included, for instance, along the perimeter of the zero yard run/pass target 70. The penalty would be scored as an incomplete pass (or run) or a loss of five yards.

(j) Fumbles

A fumble zone 88 could be hit by either an offensive player (on the run/pass target 70) or a defensive player (on the tackle target). When a fumble target is hit, the participants from both teams must try simultaneously to "claim the ball" by hitting their own team's half of the fumble recovery target 90 located at the bottom center of the playing surface 12. Ball possession is determined by the side of the fumble recovery target 90 that is hit first (regardless of which team threw the dart). When one team runs out of darts, it may not approach the playing surface until the other team is also out of darts.

(k) Scoring

Ball carriers running into the defender's end zone or any complete pass that crosses the defender's goal line is scored as a six point touchdown. Field goals are scored as three points. A one-point convert for touchdowns is awarded by hitting anywhere inside the field goal target. Two-point converts for touchdowns are possible by completing a single dart run/pass play that makes at least two yards. After scoring a touchdown, as when deciding to kick a field goal, the offensive player could be required to alert the microprocessor 124 that a one point convert is being attempted as opposed to a two point convert by pressing the field goal button 46. Alternatively, the player could be awarded the appropriate convert score if either target is hit.

Computerized Game Method (a) Overall Game Operation

Figure 5A:
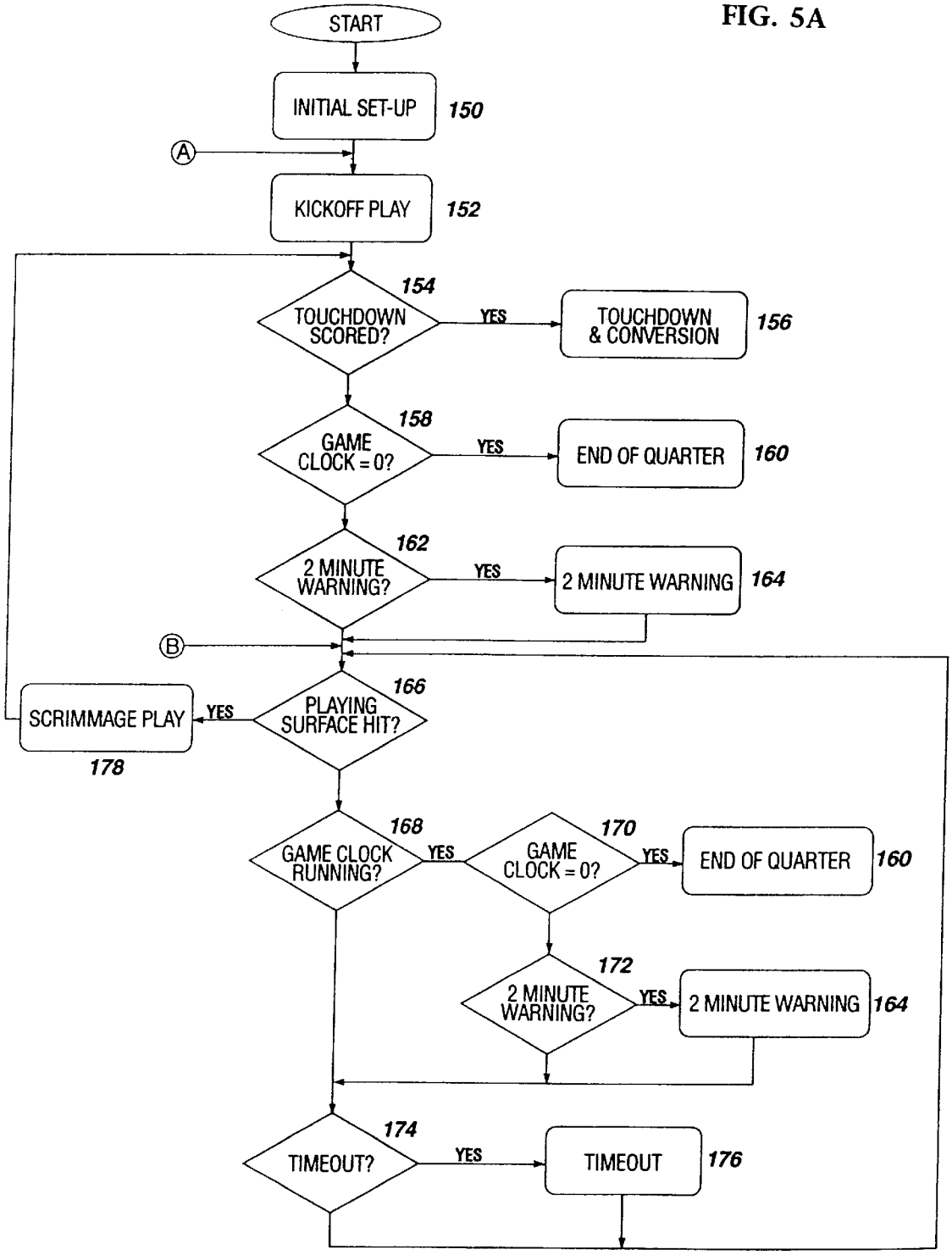
FIG. 5 (a–j) is a flow chart illustrating the sequence of operations for a method of playing a game in accordance with the present invention.

Referring to FIG. 5*a*, an illustrative embodiment of the general modules in the overall game program operation is shown in flow chart form as described in detail below. The start of a game is preceded by an Initial set-up step shown in module 150. The game then begins with a Kickoff play, illustrated by module 152. A kickoff play also occurs at the start of the second half and after every touchdown or field goal scored. Step 152 is followed by a test 154 for whether a touchdown has been scored. If so, the game passes to a touchdown and conversion routine 156. If a touchdown was not scored then step 158 checks whether the game clock is at zero, and if so the game program proceeds to the End of quarter routine 160. If the game clock is not at zero, step 162 checks whether a two minute warning should be given. If so, module 164 provides a suitable announcement and also stops the game clock. Test 166 checks whether the playing surface 12 has been hit, to commence the next play, and if not a series of additional tests are performed. If the game clock is still running, as determined in step 168, tests 170 and 172 again check whether the end of a quarter has been reached or whether a two minute warning should be given. Next, step 174 determines whether a team has pressed its timeout button. Timeout routine 176 checks whether a team has any remaining timeouts, and if so, stops the game clock and provides a suitable announcement before completing the "playing surface not hit yet" loop created by test 166. When the playing surface 12 is hit, a play other than a kickoff (a "scrimmage play") is taking place. The program then passes to Scrimmage Play module 178 and the program returns to test 154, and the subsequent tests and related routines repeat as shown in FIG. 5*a*.

(b) Initial Set-up Routine

Figure 5B:
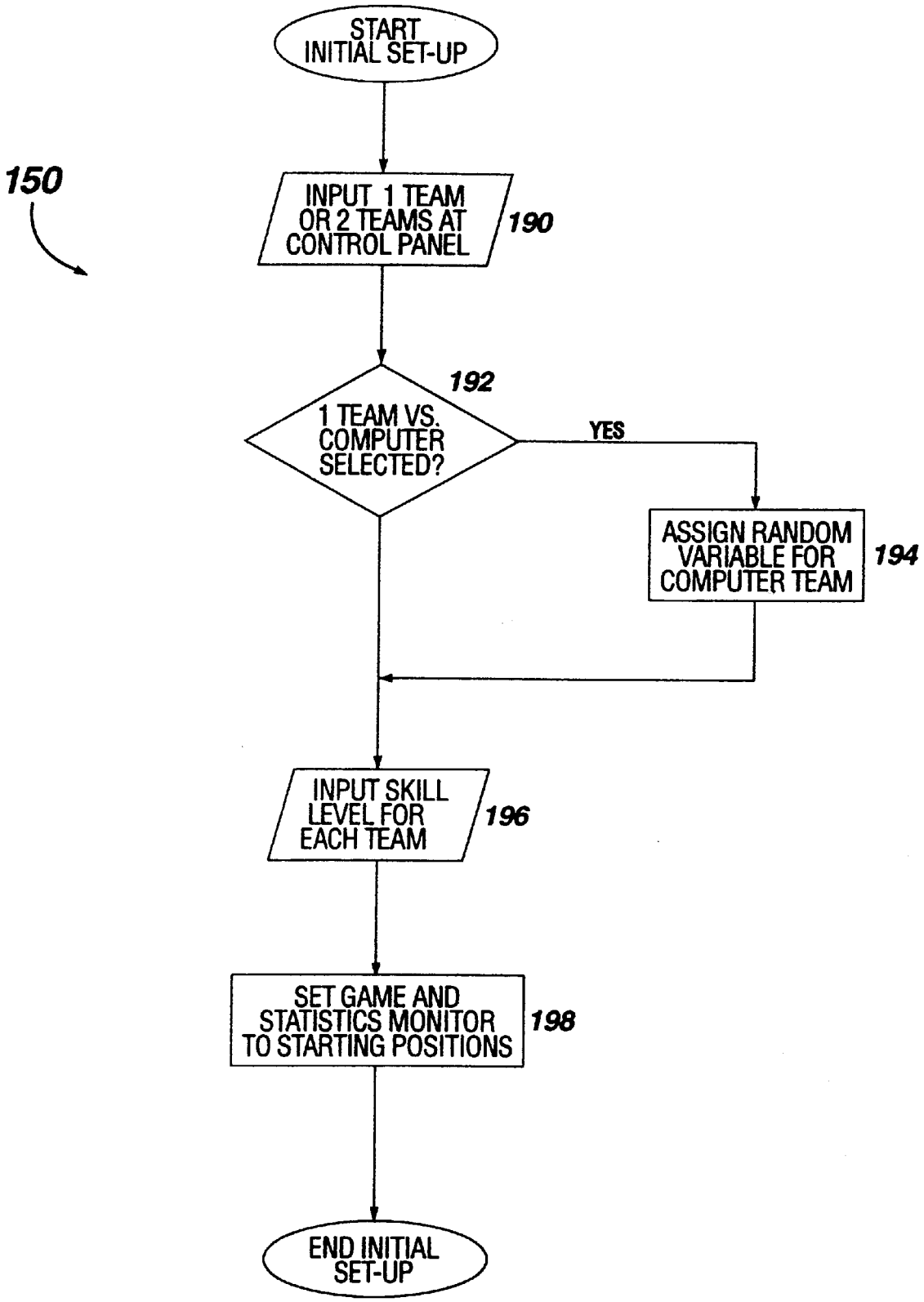

FIG. 5*b* shows the various steps in the initial set-up module routine 150. First, at 190, the user or users are required to input whether both teams will consist of human players or whether one team will be controlled by the microprocessor 124. If "One Player vs. Computer" is selected, a pseudo-random number generator (not shown) is used to provide variation in the play of the microprocessor 124 controlled team, as shown at steps 192 and 194. The skill level of each team, which affects the setting of the running counter 76, is then input at 196. Before the game begins, in step 198 the game monitor and statistics monitor are set to their initial positions.

(c) Kickoff Routine

Figure 5C:
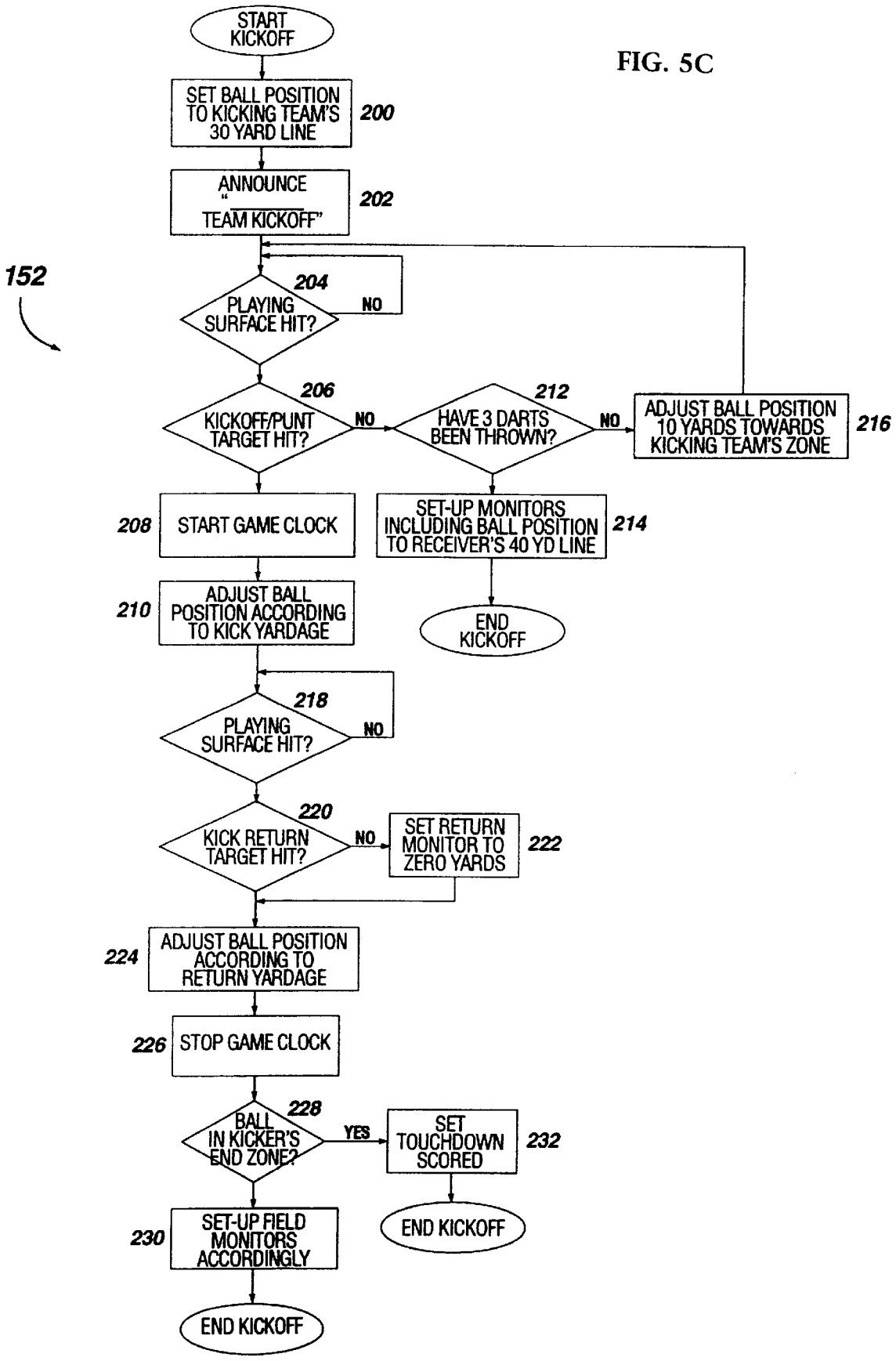

FIG. 5*c* shows the steps involved in a kickoff play 152. Before a kickoff play begins, the team that will be kicking is known. For instance, at the start of the game this will be the Visitor team. To start the play, the ball is placed at the kicking team's 30 yard line at step 200. At 202, the game announces "HOME/VISITOR TEAM KICKOFF." The game then waits for the kicking team to throw a dart at the playing surface 12, as illustrated at 204. Although not shown, the game may incorporate a delay of game routine, as in real football, to penalize the team controlling the ball when it waits too long before starting a play. Thus, in this instance, if the playing surface 12 was not hit before a specific time period expired, the kicking team would be penalized. Generally, the delay of game routine would run in most instances in which the game program is awaiting a dart to hit the playing surface 12.

Referring still to FIG. 5*c,* when the playing surface 12 is hit then the game checks, at step 206, whether the kickoff/punt target 52 was hit. If so, the game clock is started at 208, and the field monitor is adjusted accordingly in step 210. If the kickoff/punt target 52 was not hit, then the game checks, in step 212, whether three kickoff darts have been unsuccessfully thrown, and, if so, the kickoff play ends with step 214 which automatically sets-up the field monitor variables including placing the ball on the receiving team's 40 yard line. If less than three kickoff darts have been unsuccessfully thrown, the field monitor is adjusted back 10 yards toward the kicking team's end zone by step 216. If the punt/kickoff target was hit, the game then waits for the receiving team to throw a dart at the playing surface 12 in step 218. If the kick return target 54 is not hit, as checked by step 220, zero return yards are awarded at 222. Step 224 then adjusts the field monitor in the direction of the kicking team's end zone, in accordance with the return yards awarded. Next, as in real football, the game clock is stopped as shown by step 226. To conclude the kickoff play, test 228 checks whether the ball has been returned inside the kicking team's end zone, and if so the game registers that a touchdown has been scored in step 232. If not, step 230 sets-up the field monitor variables, i.e. which team has possession (i.e. the receiving team), ball position, down (i.e. first), and yards to go for a first down (which will be ten unless a touchdown was scored or the ball was returned to within ten yards of the defensive team's end zone). If a delay of game routine is included, the "play clock" used for that purpose could be included as one of the monitor variables wherein either step 230, step 232 or step 214 would start the play clock running. Generally, the field (and statistic) monitor variables are adjusted after each play.

(d) Touchdown and Conversion Routine

The steps in the touchdown and conversion routine 156 are shown in FIG. 5*d.* Six points are added to the score monitor 34 (in favour of the team that scored) in step 240, and a touchdown and instructions to attempt a convert are announced in step 242. For the convert attempt, the ball is placed at the defensive team's two yard line (step 244). The game program then waits for the offensive team to throw a dart at the playing surface 12 in step 246. Once this occurs test 248 determines whether the field goal target was hit, and if so one point is added to the offensive team's score (step 250), an appropriate announcement is made (step 252), and the game proceeds to step 286. If the field goal target was not hit test 254 checks whether an offensive run/pass target 70 was hit. If not (or if the pass was completed out of bounds beyond the back of the end zone), the convert is unsuccessful and an appropriate announcement is made in step 256 before the program proceeds to step 286.

If an inbounds offensive run/pass target 70 was hit, the ball position or field monitor is adjusted in step 258 in accordance with the yardage gained. Step 260 checks whether the ball is now in the defensive team's end zone, and if so two points are added to the score and a related announcement is made (steps 262 and 264 respectively) before proceeding to step 286. If the ball is not in the end zone, test 266 determines whether the ball has been fumbled. In this illustrated embodiment a fumble, once recovered, cannot then be advanced by either team for any subsequent yardage gain. Therefore, if there has been a fumble (and since the ball is not yet in the end zone as previously determined by test 260), step 268 announces that the convert attempt was no good, before proceeding to step 286. If no fumble occurs, step 270 starts the running counter 76 and auto yardage adjustment of the game program, which has already been described in detail above. With the running counter 76 on, step 272 continuously tests whether the ball has reached the end zone until the correct tackle target is properly hit, as determined by step 280. If the ball reaches the end zone first, the running counter 76 is stopped in 274, two points are added to the offensive team's score (step 276), and a suitable announcement is made (step 278). If the tackling target is hit first, step 282 stops the running counter 76, and an "unsuccessful" announcement is made in step 284 before proceeding to step 286.

Step 286 sets the ball possession for the ensuing kickoff. Test 288 then checks whether the game clock is at zero and if so jumps to the End of quarter routine 160. If there is time remaining, the program continues via point "A" as illustrated in FIGS. 5*a* and 5*d.*

(d) End of Quarter Routine

Figure 5E:
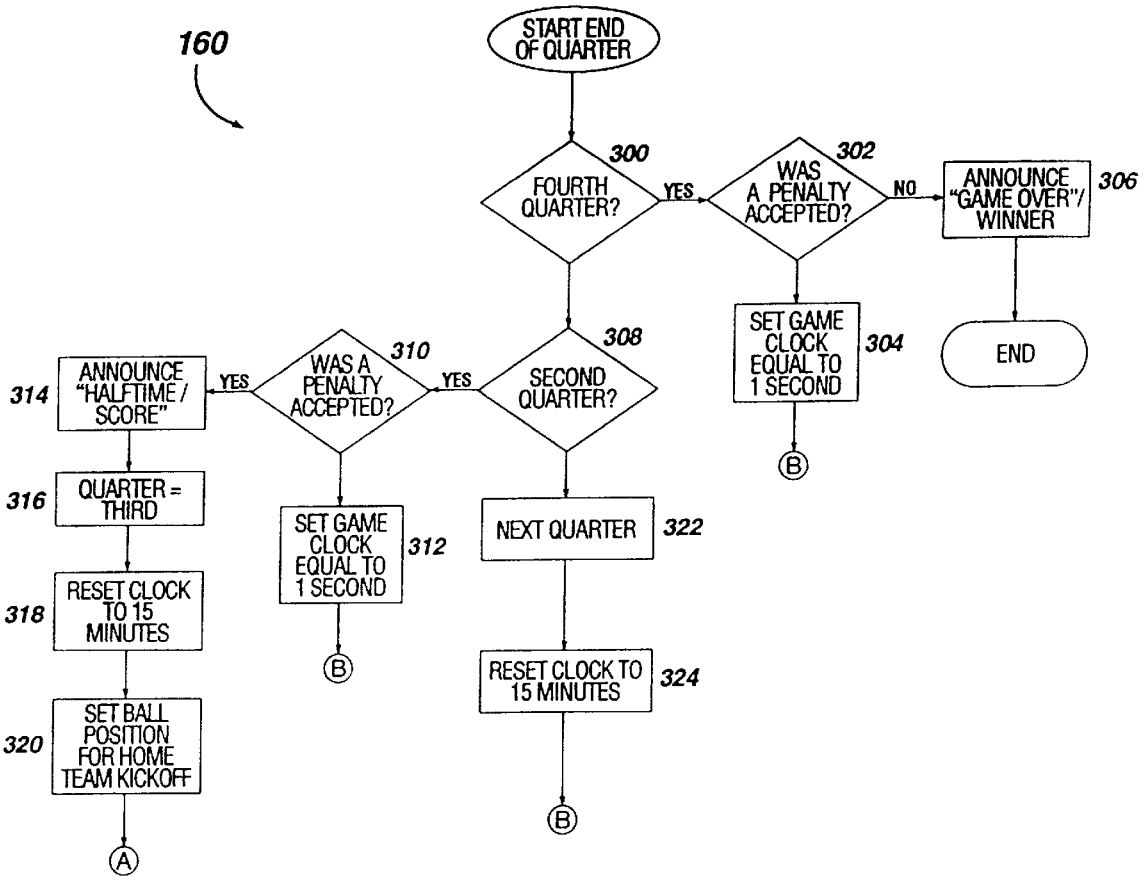

FIG. 5*e* shows the steps in the End of quarter routine 160. Step 300 first determines whether the fourth quarter just ended. If so, step 302 checks whether a penalty was accepted after the last play. If not, step 306 announces a winner and that the game is over. Although not shown, the game program could also include an additional overtime period if the score in the game is tied at this point. If a penalty was accepted, step 304 adjusts the game clock (e.g. adds one second to it) so that one more play can be run before the end of the game. The program then continues via point "B" as illustrated in FIGS. 5*a* and 5*e.*

If the fourth quarter was not just completed but rather the second quarter was (as determined by test 308), step 310 also checks whether a penalty has just been accepted after the last play, and if so step 312 adjusts the game clock (e.g. adds one second to it) so that one more play can be run before the end of the first half. If test 310 determines that no penalty was accepted, half time is announced (step 314), the current quarter becomes the third (step 316), the game clock is reset to fifteen minutes (step 318), and ball possession is set for the home team to kickoff to begin the second half (step 320). The program then continues via point "A" as illustrated in FIGS. 5*a* and 5*e.*

If either the first or third quarter just ended, step 322 augments the quarter number by one and step 324 resets the game clock to fifteen minutes, before the program continues via point "B" as illustrated in FIGS. 5*a* and 5*e.*

(f) Scrimmage Play Routine

Figure 5F:
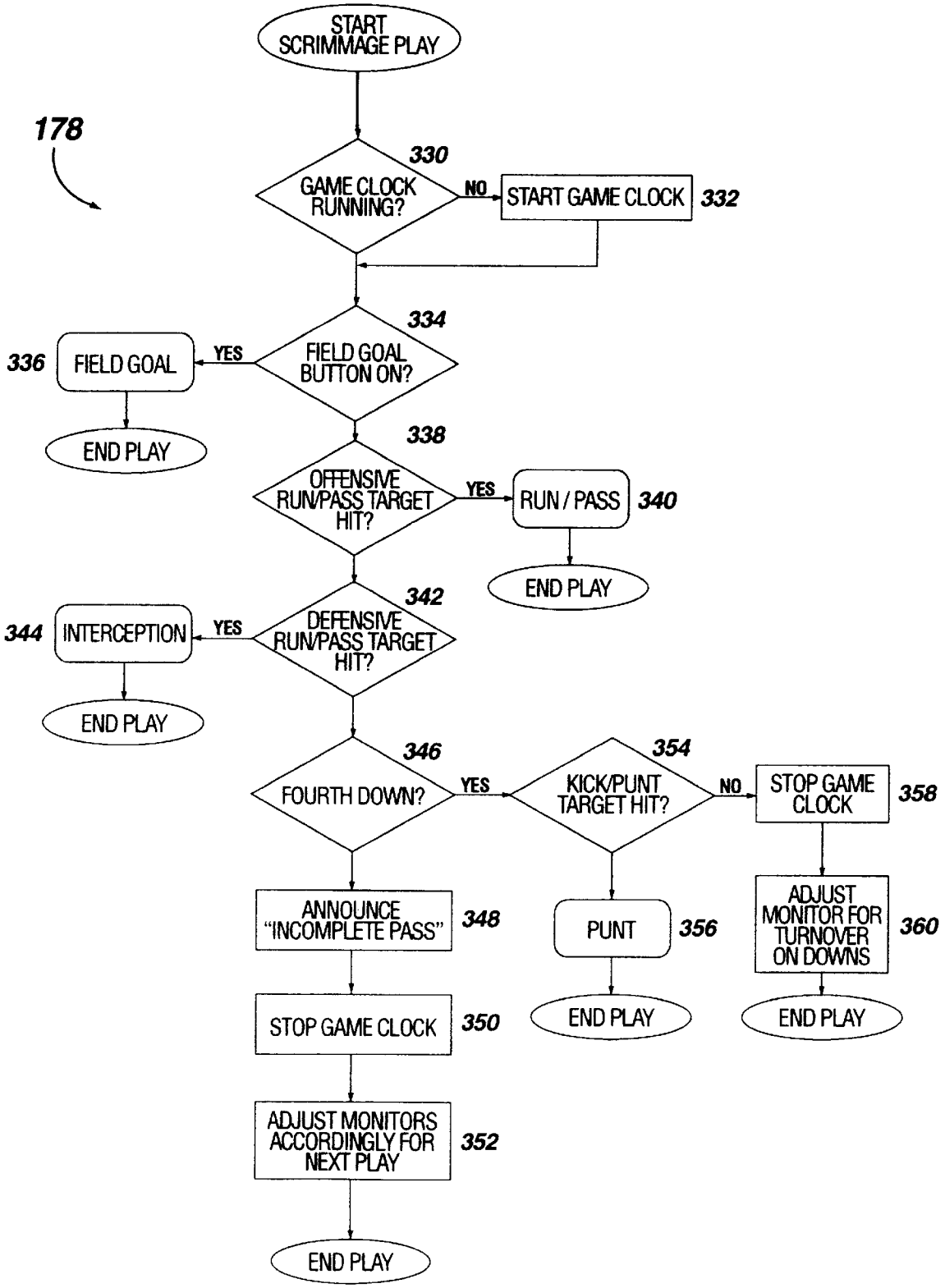

FIG. 5*f* shows the steps in a "scrimmage" play 178. Step 330 first checks whether the game clock is running, and if not step 332 starts it. Next, test 334 checks whether the offensive team's field goal button 46 is on, and if so the game passes to the Field goal routine 336, described further below. If the button is not on, test 338 determines whether an offensive run/pass target 70 was hit, and if so the game proceeds to the run/pass routine 340 described further below. If an offensive target was not hit, step 342 checks whether a defensive run/pass target 70 was hit, and if so the game program is sent to an Interception routine 344 described in more detail below. If none of these targets were hit, step 346 tests whether it is fourth down. If not fourth down, step 348 announces an incomplete pass, step 350 stops the game clock, and step 352 adjusts the monitors (i.e adds a down) accordingly for the next play. If it is fourth down, step 354 determines whether the kick/punt target was hit, and if so the game program passes to the punt routine 356 described further below. If that target was not hit, step 358 stops the game clock and step 360 adjusts the monitors accordingly (i.e. for the ball to be turned over on downs).

(g) Field Goal Routine

Figure 5G:
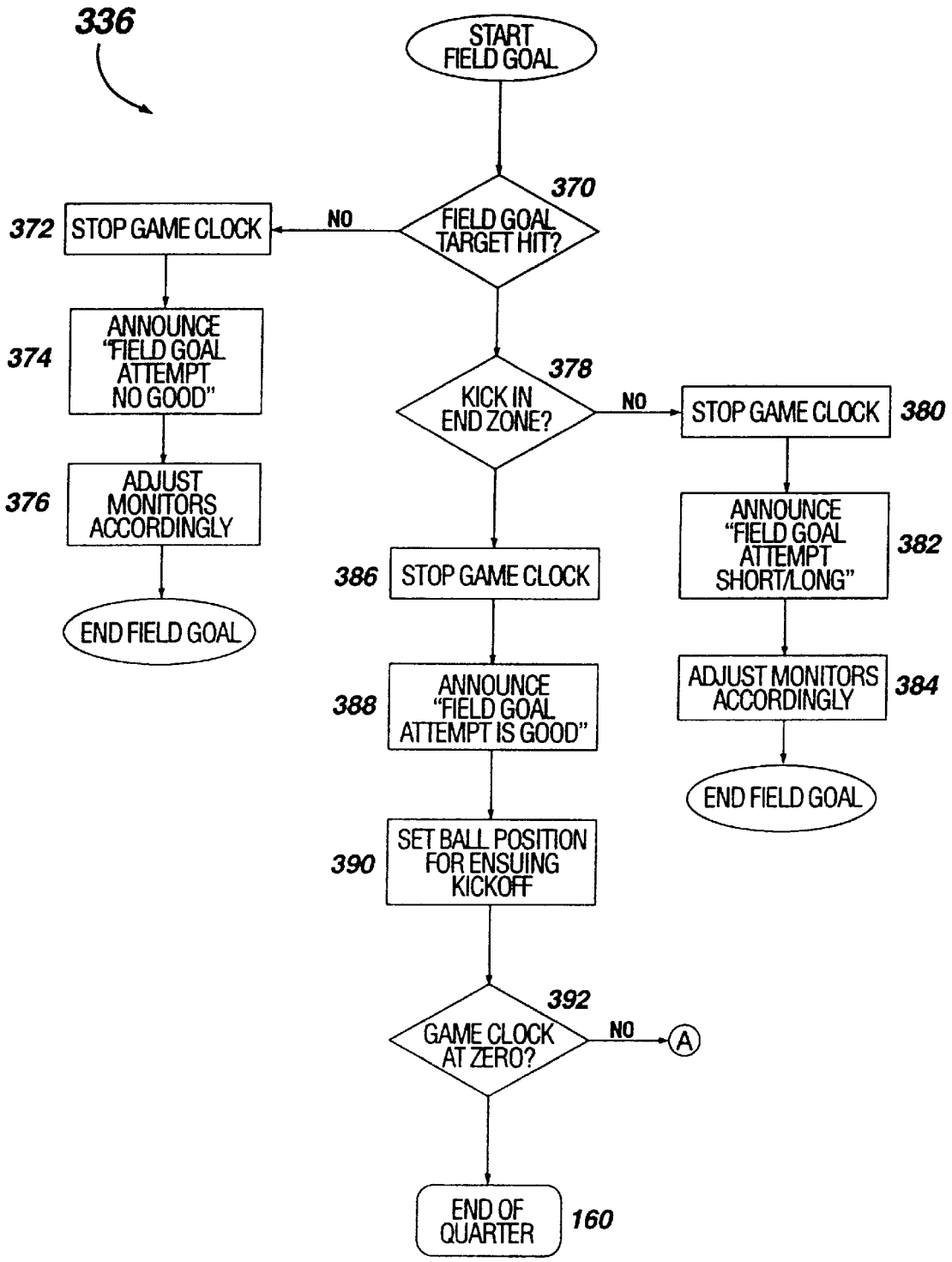

The steps in the Field goal routine are shown in FIG. 5*g*. Test 370 first checks whether the field goal target was hit. If not the game clock is stopped (step 372), an announcement that the field goal attempt was no good is made (step 374), and the monitors are adjusted accordingly (step 376). If the target was hit, but the kick was not long enough to score a field goal (as determined in step 378), the game clock is stopped (step 380), an announcement that the field goal attempt was short and no good is made (step 382), and the monitors are adjusted accordingly (step 384). If the kick was long enough, step 386 stops the game clock, step 388 announces that the field goal attempt was good, step 390 sets the ball possession for the ensuing kickoff, and step 390 checks whether the game clock is at zero. If the clock is at zero the program jumps to the end of quarter routine 160. If there is time remaining, the program continues via point "A" as illustrated in FIGS. 5*a* and 5*g*.

(h) Run/Pass Routine

Figure 5H:
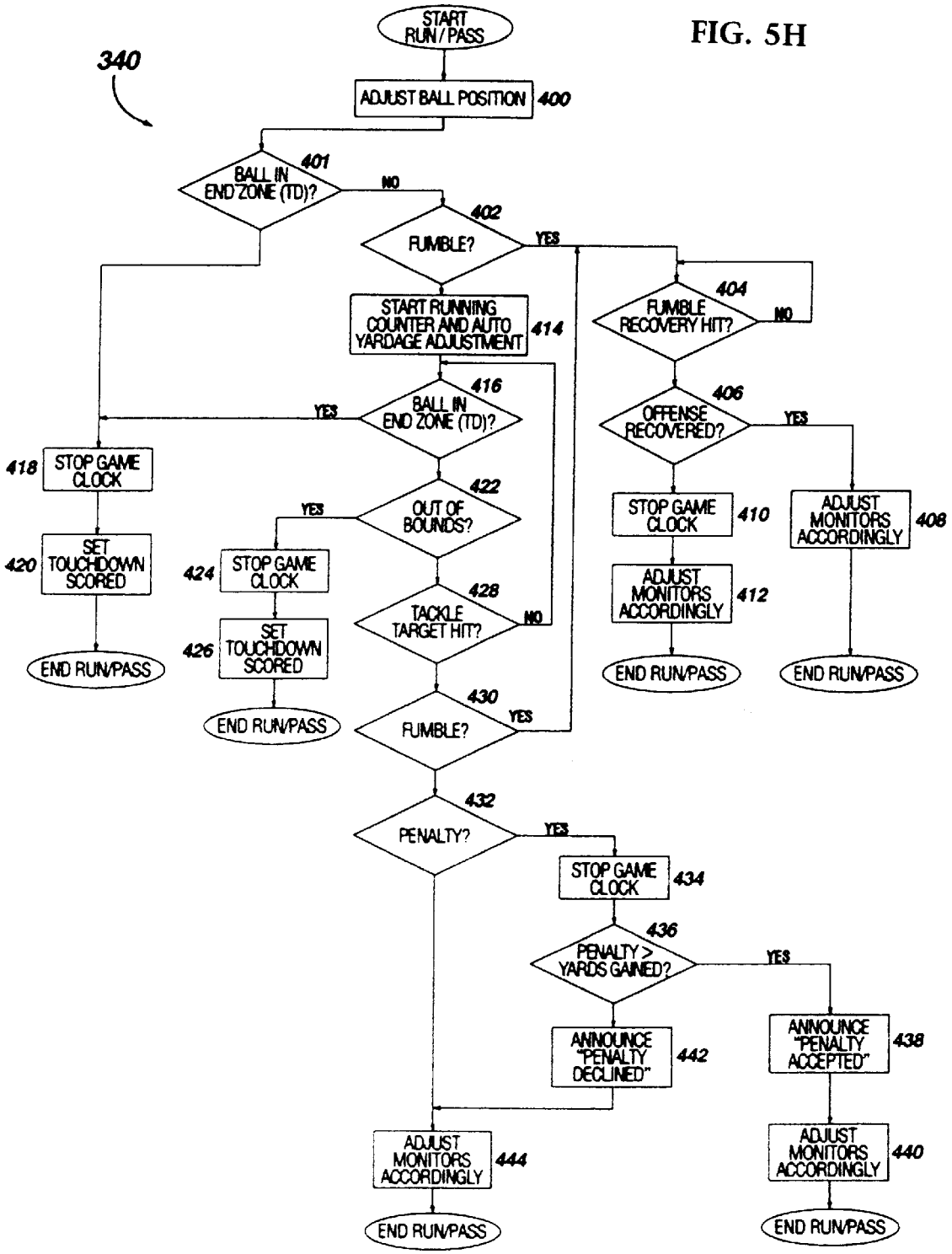

The steps in the run/pass routine 340 are shown in FIG. 5*h*. Step 400 adjusts the ball position according to the target hit. Test 401 determines whether the ball is in the defensive team's end zone and if so proceeds to step 418, described below. If the ball is not in the end zone, test 402 determines whether the ball was fumbled, and if so test 404 waits for one of the sides of the fumble recovery to be hit. If the offence recovered the football 42, as determined in step 406, step 408 adjusts the monitors accordingly (recall that in this illustrated embodiment the ball cannot be advanced by either team after a fumble). If the defence recovered, step 410 stops the game clock and step 412 adjusts the monitors accordingly (in this case for a turnover). If there was no fumble (and the pass was not completed out of bounds beyond the back of the end zone), step 414 starts the running counter 76 and auto yardage adjustment of the game program, which has already been described in detail above. With the running counter 76 on, step 416 continuously tests whether the ball has reached the end zone, step 422 continuously checks whether the ball carrier has gone out of bounds (i.e. if 8 yard pass was completed) and step 428 continuously checks whether the correct tackle target is hit. If the ball reaches the end zone first, step 418 stops the game clock and step 420 sets a "touchdown scored" variable. If the ball carrier goes out of bounds first step 424 stops the game clock and step 426 adjusts the monitors accordingly. If neither of these outcomes occurs before the tackling target is hit, once the latter occurs, test 430 again checks for a fumble. If the ball was fumbled, the routine is passed to step 404 and the program proceeds as just described above. If there is no fumble, step 432 determines whether there was a penalty during the play (i.e. when the tackling target was hit). If so, step 434 stops the game clock, and then test 436 determines whether the potential penalty yardage is greater than the yards gained during the play. If the former is greater, step 438 announces that the penalty is accepted, and then step 440 adjusts the monitors accordingly. If the former is not greater, the penalty is declined in step 442 and the monitors are then adjusted accordingly in step 444. If there was no penalty on the play, the routine passes directly to step 444.

(i) Interception Routine

FIG. 5*i* shows the steps in the Interception routine 344. The interception is announced in step 450. Step 452 checks for a fumble, and if one occurred, test 454 waits for the ball to be recovered. Once this occurs, step 456 stops the game clock, before step 458 determines which team recovered the fumble. If the team that intercepted recovered the monitors are adjusted in step 460, and if the team that threw the interception recovered the monitors are adjusted in step 462. If there was no fumble, step 464 starts the running counter 76 and auto yardage adjustment of the game program. With the running counter 76 on, step 466 continuously tests whether the ball has reached the offensive end zone, step 472 continuously checks whether the ball carrier has gone out of bounds (i.e. if 8 yard pass was completed) and step 478 continuously checks if the correct tackle target is hit. If the ball reaches the end zone first, step 468 stops the game clock and step 470 sets a "touchdown scored" variable. If the ball carrier goes out of bounds first step 474 stops the game clock and step 476 adjusts the monitors accordingly. If neither of these outcomes occurs before the tackling target is hit, once this occurs, test 480 again checks for a fumble. If the ball was fumbled, the routine is passed to step 454 and the program proceeds as just described above. If there is no fumble, step 482 stops the game clock. Test 484 then determines whether there was a penalty during the play (i.e. when the tackling target was hit). If so test 486 determines whether the potential penalty yardage is greater than the yards gained during the interception return. If the former is greater, step 488 announces that the penalty is accepted, and then step 490 adjusts the monitors accordingly. If the former is not greater, the penalty is declined in step 492 and the monitors are then adjusted accordingly in step 494. If there was no penalty on the play, the routine passes directly to step 494.

(j) Punt Routine

FIG. 5*j* shows the steps in the punt routine 356. Steps 500 to 516 are identical to and operate in the same manner the corresponding steps 210 to 232 of the kickoff routine as shown in FIG. 5*c*, and as already described.

It is clear from the above description that FIGS. 5*a–j* illustrate only one possible implementation for the game operation of the present invention. Numerous other implementations are possible. For instance, instead of starting and stopping a live game clock, the game could simply attribute fixed durations to particular types of plays (for e.g., 40 seconds for plays after which the clock does not stop and 10 seconds for plays after which the clock stops).

Simplified Game Apparatus

Figure 6:
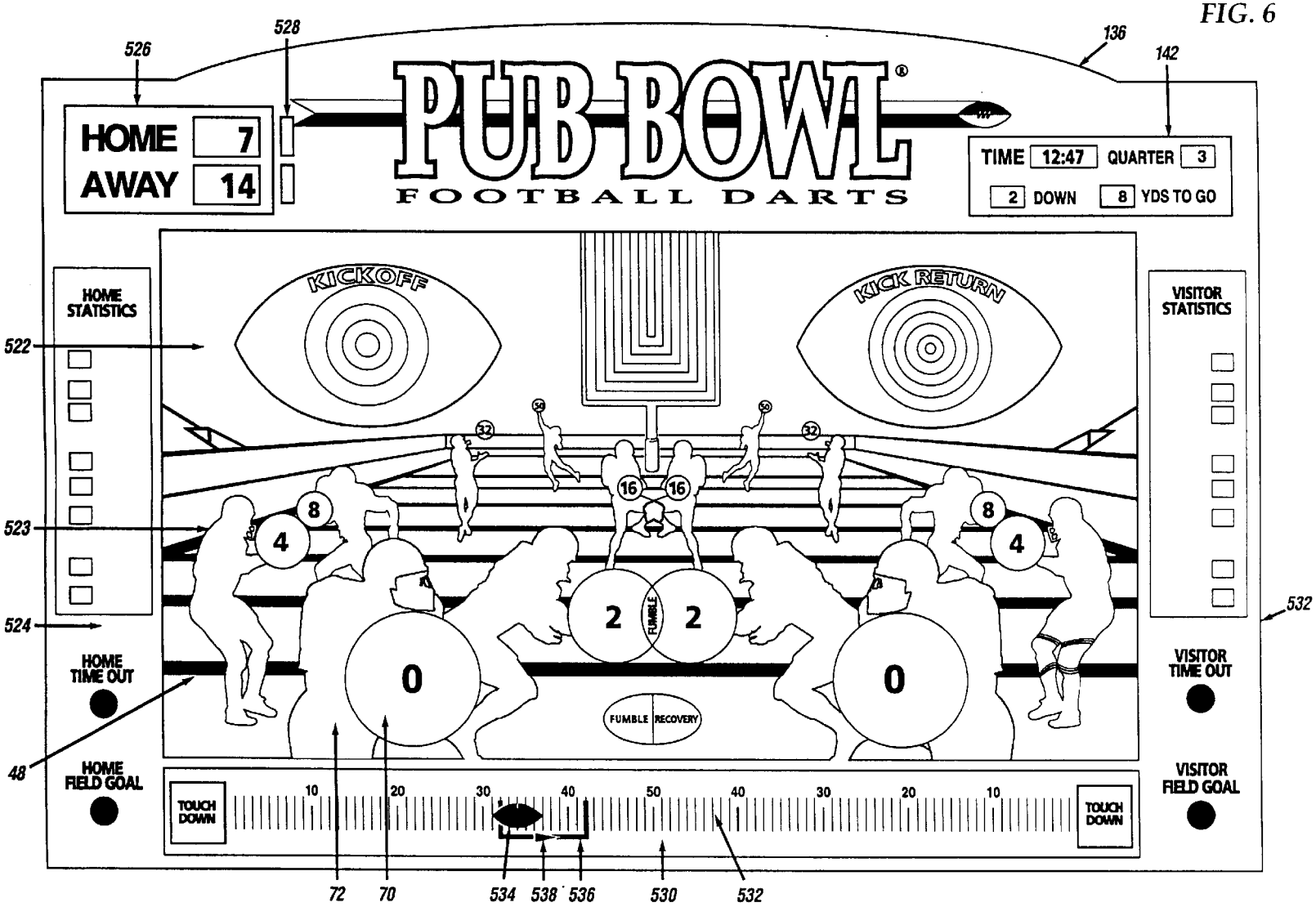
FIG. 6 is a second embodiment of the game apparatus in accordance with the present invention.

A second embodiment of a dart game apparatus 10 in accordance with the present invention is shown generally at 520 in FIG. 6. This embodiment is intended primarily for home use which is less costly and more portable than the sophisticated electronic version described earlier. The home version of the apparatus 10 includes a playing surface 522 and a display surface 524. The playing surface 522 is preferably made from a traditional dart board material, such as a bristle board or a cork board. The front surface of the board is painted to depict field markings 48 and target markings. A metal spider 523 is positioned over the playing surface 522 to define perimeter walls for the target markings.

As with conventional dart boards, it is anticipated that the playing surface 522 would be replaced from time to time as the markings become worn away and the surface becomes less receptive to darts.

The display surface 524 includes score monitors 526 for indicating information concerning points scored, downs and yards to go. The monitors are adjusted manually with rotatable number changers 528 as known in the art. A field monitor 530 is also provided at the bottom end of the display surface 524. The field monitor 530 visually depicts a schematic representation of the field. The field monitor 530 includes a slide 532 upon which a ball marker 534 and a 10 yard indicator 536 are slidably mounted. A direction arrow 538 is pivotally mounted to the ball marker 534 for indicating the direction of offensive ball movement. In use, the ball marker 534 is moved relative to the 10 yard marker to indicate distance gained during each series of downs. When a first down is obtained, the 10 yard marker is moved to the new line of scrimmage to indicate the next 10 yard distance to be obtained. When a change in ball possession occurs, the ball direction indicator is pivoted to face in the opposite direction and the 10 yard indicator 536 is adjusted so that its opposing side marks the beginning of the line of scrimmage.

The earlier described method of play may also be applied to the above-noted home game version of game apparatus 10. The score monitor 34 and field monitor 530 must be manually adjusted during each play, however. Also, to be practical, the running counter 76 must operate according to the number of tackle darts thrown (instead of the elapsed time between hitting a run/pass target 70 and hitting a corresponding tackle target). Thus, the earlier described "running speed" determined according to up to six tackle darts being thrown could be applied.

It is to be understood that what has been described is a preferred embodiment of the invention. The invention is nonetheless susceptible to certain changes and alternative embodiments fully comprehended by the spirit of the invention as described above, and the scope of the claims set below. For instance, it is contemplated that the invention could be adapted to other sports such as baseball, hockey or any other sport involving offensive and defensive interaction. For example, it is contemplated that the active target feature of the invention could be used when a batsman is running the bases in baseball until such time as his advancement is stopped by a defensive target being struck (e.g. a target corresponding to a particular base in baseball).

I claim:

1. A game apparatus comprising:

a playing surface for receiving projectiles;

at least one active target defined on said surface, said active target defining at least one action zone and at least one reaction zone;

sensor means associated with said surface for electronically sensing when and where a projectile hits said surface;

active counter means communicating with said sensor means for awarding score values according to a measuring factor occurring between when said action zone of said active target is hit and when said reaction zone of said active target is hit; and processing means for receiving and processing information from said sensor means and from said active counter means and awarding a score.

2. A game apparatus as claimed in claim 1, wherein said projectiles comprise darts.

3. A game apparatus as claimed in claim 1, wherein said measuring factor is time-sensitive and said active counter means includes a timer for measuring the elapsed time between when a projectile hits said action zone and when a projectile hits said reaction zone.

4. A game apparatus as claimed in claim 3 wherein said measuring factor is further sensitive to a user-selectable skill factor.

5. A game apparatus as claimed in claim 1, wherein said measuring factor is attempt-sensitive and said active counter means comprises a counter for measuring the number of projectiles hitting said surface after said action zone has been hit and before said reaction zone has been hit.

6. A game apparatus as claimed in claim 5 wherein said measuring factor is further sensitive to a user-selectable skill factor.

7. A game apparatus as claimed in claim 5, wherein said counter means stops counting and automatically awards a final score once a predetermined number of projectiles has hit the surface.

8. A game apparatus as claimed in claim 1, wherein said playing surface includes visible markings that depict a sports field.

9. A game apparatus as claimed in claim 1, further comprising at least one passive target defined on said surface, said processing means awarding a predetermined score when said passive target is hit.

10. A game apparatus as claimed in claim 9, wherein said passive target has a plurality of score zones that are each associated with a predetermined score value.

11. A game apparatus as claimed in claim 9, wherein a plurality of different sized passive targets are provided and wherein said predetermined score for said passive targets varies inversely with the surface area of each said target.

12. A game apparatus as claimed in claim 9, wherein at least one of said active and passive targets is shaped to resemble a player playing a sport.

13. A game apparatus as claimed in claim 9, wherein one of said passive targets depicts a field goal for a football game.

14. A game apparatus as claimed in claim 1, wherein said active target is shaped to depict a football player.

15. A game apparatus as claimed in claim 1 wherein said sensor means includes means for simulating the hitting of said playing surface by a projectile.

16. A game apparatus as claimed in claim 15 wherein said simulating means simulates the hitting of said playing surface by a projectile in accordance with a user-selectable skill factor.

17. A game apparatus as claimed in claim 1 wherein a plurality of active targets having different surface areas are arranged on said playing surface in a pattern to depict a field level perspective of said sports field, and wherein said targets having a smaller surface area are located in said perspective view to appear to be at a further distance away relative to said targets having a larger surface area.

18. A method for playing a projectile throwing game comprising the following steps:

(a) selecting a playing surface for receiving projectiles, said playing surface having at least one active target, said active target having at least one action zone and at least one reaction zone;

(b) throwing a projectile at said playing surface;

(c) determining the position where said projectile hits said playing surface;

(d) assigning a score value according to where said projectile hits said scoring surface, wherein, when said projectile hits said action zone of said active target, said score value is contingent on a measuring factor based on when a subsequent projectile hits said reaction zone of said active target; and (e) repeating steps (b), (c) and (d) until a game is completed.

19. A method as claimed in claim 13, wherein said measuring factor in step (d) comprises the amount of time elapsed between when said action zone is hit and when said reaction zone is hit.

20. A method as claimed in claim 19 wherein said measuring factor is further sensitive to a user-selectable skill factor.

21. A method as claimed in claim 13, wherein said measuring factor of step (d) comprises the number of darts thrown between when said action zone is hit and when said reaction zone is hit.

22. A method as claimed in claim 21 wherein said measuring factor is further sensitive to a user-selectable skill factor.

23. A method as claimed in claim 13, wherein said playing surface further includes at least one passive target, wherein a predetermined score value is assigned when said passive target is hit.

24. A method as claimed in claim 16, wherein said passive target has a plurality of score zones that are each associated with a predetermined score value.

25. A method as claimed in claim 18 wherein said game is played by a first opponent against a second opponent.

26. A method as claimed in claim 25 wherein the play of either said first opponent or said second opponent is simulated by a processing means.

27. A method as claimed in claim 18 wherein said game is an adaptation of North American football.

28. A game apparatus comprising:

a playing surface for receiving projectiles, said playing surface including visible markings that depict a sports field;

a plurality of targets having different surface areas defined on said playing surface, said targets being arranged on said playing surface in a pattern to depict a field level perspective of said sports field, and wherein said targets having a smaller surface area are located in said perspective view to appear to be at a further distance away relative to said targets having a larger surface area;

scoring means associated with said targets for awarding a predetermined score according to whether one of said targets is hit by a projectile, said score for each target varying inversely with the surface area of said target.

29. A game apparatus as claimed in claim 18, wherein said targets include sports players positioned at various down-field perspective positions on said sports field.

30. A game apparatus as claimed in claim 28 wherein said plurality of targets are made up of a plurality of target types, and wherein targets having a smaller surface area appear to be further away than targets having a larger surface area for each specific target type.

31. A game apparatus as claimed in claim 28 wherein said scoring means comprises sensor means for electronically sensing when a target has been hit.

32. A game apparatus as claimed in claim 28 wherein said scoring means comprises visual indicia for visually indicating said predetermined score of each of said targets.

33. A game apparatus as claimed in claim 28 wherein said projectiles comprise darts.

34. A game apparatus as claimed in claim 28 wherein said sports field is a North American football field.

* * * * *